US006460800B1

(12) United States Patent
Watanabe et al.

(10) Patent No.: US 6,460,800 B1
(45) Date of Patent: Oct. 8, 2002

(54) TAPE DISPENSER HAVING A ROTATABLE DISPLAY COMPONENT FOR GRAPHIC PRESENTATION

(75) Inventors: Hiro Watanabe, Covington, KY (US); John E. Elleman, Cincinnati, OH (US); Gina Beckerink, Cincinnati, OH (US); Travis Brausch, Cincinnati, OH (US)

(73) Assignee: Elmer's Products, Inc., Columbus, OH (US)

( * ) Notice: Subject to any disclaimer, the term of this patent is extended or adjusted under 35 U.S.C. 154(b) by 95 days.

(21) Appl. No.: 09/651,497

(22) Filed: Aug. 30, 2000

(51) Int. Cl.[7] ..... B65H 16/06

(52) U.S. Cl. ..... 242/598.5; 206/4; 206/11; 225/6; 225/17; 225/77; D19/67; D19/100

(58) Field of Search ..... 242/588, 588.3, 242/405.1, 590, 598.5, 598.6, 599.3, 599.4; D19/65, 66, 67, 69, 70, 75, 95, 89, 99, 100; 156/523, 527, 540, 576, 577; 206/389, 395, 396, 397, 398, 411, 415, 402, 527; 225/6, 7, 9, 44–47, 49, 56, 65, 17, 77; 312/34.8

(56) References Cited

U.S. PATENT DOCUMENTS 3,396,471 A * 8/1968 Taylor ..... 225/17
3,456,854 A * 7/1969 Condy ..... 225/17
3,557,747 A * 1/1971 Rigney et al. ..... 206/533
3,695,514 A * 10/1972 Mascetti, Jr. ..... 206/527
5,472,560 A * 12/1995 Horng ..... 156/523
5,996,932 A * 12/1999 Wang ..... 242/598.5
D446,246 S * 8/2001 Kimura ..... D19/67

OTHER PUBLICATIONS

Photocopy of tape dispenser in Examiner Marty Holtje's possession since 1996.*

* cited by examiner

*Primary Examiner*—William A. Rivera
(74) *Attorney, Agent, or Firm*—Standley & Gilcrest LLP

(57) ABSTRACT

A tape dispenser having a novel display ability. The tape dispenser of the present invention may be of a common size, shape and construction typically associated with dispensers for dispensing adhesive cellulose tapes, or may be of alternate shape. The body of the dispenser may be made of plastic or other materials and may be transparent, translucent or opaque. At least one rotatable display component, such as a wheel, is preferably located between the tape roll and an inside wall of the dispenser body. One or more graphics, such as images, wording or both, are located on the rotatable display component. The rotatable display component may be rotated, either independently or in conjunction with rotation of the tape roll, such that the graphic or graphics will periodically appear through the body of the dispenser or through an aperture or other opening located therein. One or more fixed graphics may also be affixed to the body of the dispenser. The fixed graphics may convey an independent message, or may work in conjunction with one or more graphics located on the rotatable display component to form a composite image or phrase, for example. The rotatable display components and fixed graphics may be located on various sides of the dispenser body and in various combinations.

43 Claims, 12 Drawing Sheets

TAPE DISPENSER HAVING A ROTATABLE DISPLAY COMPONENT FOR GRAPHIC PRESENTATION

BACKGROUND

Tape dispensers similar to that of the present invention are well known in the art for dispensing rolls of tape. Although the exact shape of the tape dispenser may vary somewhat, the configuration generally includes a member for mounting the tape roll, wherein the tape roll is largely contained within the dispenser body, and a device for facilitating the tearing off of individual sections of tape from the tape roll.

The tape dispenser body may be transparent, translucent, opaque or colored. The dispenser body may also contain or possess an insert, sticker or decal for exhibiting a graphic, such as an image, wording, or both. Such a tape dispenser is often removably attached to a card or similar backing, which may also be used to exhibit a graphic and also to assist in the hanging of the tape dispenser as part of an in-store display. Most often, the graphics accompanying such a tape dispenser are used to convey a brand name to a customer, and possibly other items such as dimensional or quantity data associated with the tape.

As with virtually any other product, sales may be generated, at least in part, by attractive packaging. With regard to the tape dispenser of the present invention, such packaging may be wide-ranging, as both adults and children may use the tape located therein.

SUMMARY OF THE INVENTION

The tape dispenser of the present invention takes advantage of this fact by introducing a novel display component to a conventional-type tape dispenser. The present invention contemplates a rotatable display component that may preferably be moved independently of, or in conjunction with the rotation of the tape roll portion of the tape dispenser. The rotatable display component may be used to exhibit a graphic. The graphic located on the rotatable display component may be visible only at certain positions of rotation, or alternatively, may be continually visible through the dispenser body. The graphic located on the rotatable display component may further cooperate with other fixed graphics on the dispenser body to form a composite scene, phrase, or theme.

Accordingly, the present invention includes, in general terms, a tape dispenser comprising a dispenser body; a mounting device for receiving a tape roll; and at least one rotatable display component residing between said tape roll and said dispenser body; wherein said rotatable display component may be rotated independently of or in conjunction with said tape roll to display one or more graphics.

The tape dispenser body may be made of any appropriate material, typically plastic, and may be transparent, translucent or opaque.

The tape dispenser may have a single rotatable display or a rotatable display residing respectively between both sides of said tape roll and said dispenser body. The tape dispenser may optionally comprise one or more fixed graphic(s) located on said dispenser body, and the fixed graphic(s) may be part of a label affixed to a surface of said dispenser body. The fixed graphic(s) may be affixed to a surface of said dispenser body by any appropriate method, such as silk-screening or hot stamping.

Optionally, the fixed graphic(s) may be located on the same side of said dispenser body as said rotatable display component. The fixed graphic(s) may form , in conjunction the one or more graphic(s) located on said at least one rotatable display component, a composite graphic.

Also, the fixed graphic(s) may be located on the side of said dispenser body opposite that of said rotatable display component, or the fixed graphic(s) may be located on both sides of said dispenser body.

The tape dispenser may optionally comprising a base portion for providing support for said tape dispenser when in an upright position, and may include a cutting device for separating individual sections of tape from said tape roll.

In another embodiment, the tape dispenser may include: a dispenser body; a mounting device for receiving a tape roll; a cutting device for separating individual sections of tape from said tape roll; at least one rotatable display component residing between said tape roll and said dispenser body; and at least one graphic located on said at least one rotatable display component; wherein said rotatable display component may be rotated independently of or in conjunction with said tape roll to display said at least one graphic.

The tape dispenser body, the rotatable display component (s) and the fixed graphic(s) may be as described above.

In another embodiment, the tape dispenser of the present invention generally includes: a dispenser body; a mounting device for receiving a tape roll; a cutting device for separating individual sections of tape from said tape roll; at least one rotatable display component residing between said tape roll and said dispenser body; and at least one graphic located on said at least one rotatable display component; wherein said rotatable display component may be rotated independently of or in conjunction with said tape roll to display said at least one graphic through an aperture of said dispenser body.

The tape dispenser body, the rotatable display component (s) and the fixed graphic(s) may be as described above.

Although, as described herein, the tape dispenser of the present invention may appear to appeal primarily to children, it should be noted that the graphics that may occur on the rotatable component are virtually unlimited in variety. As such, it is possible to produce such a tape dispenser that may also be appealing, and possibly useful to adults.

DETAILED DESCRIPTION OF THE EMBODIMENT(S)

Figure 1:
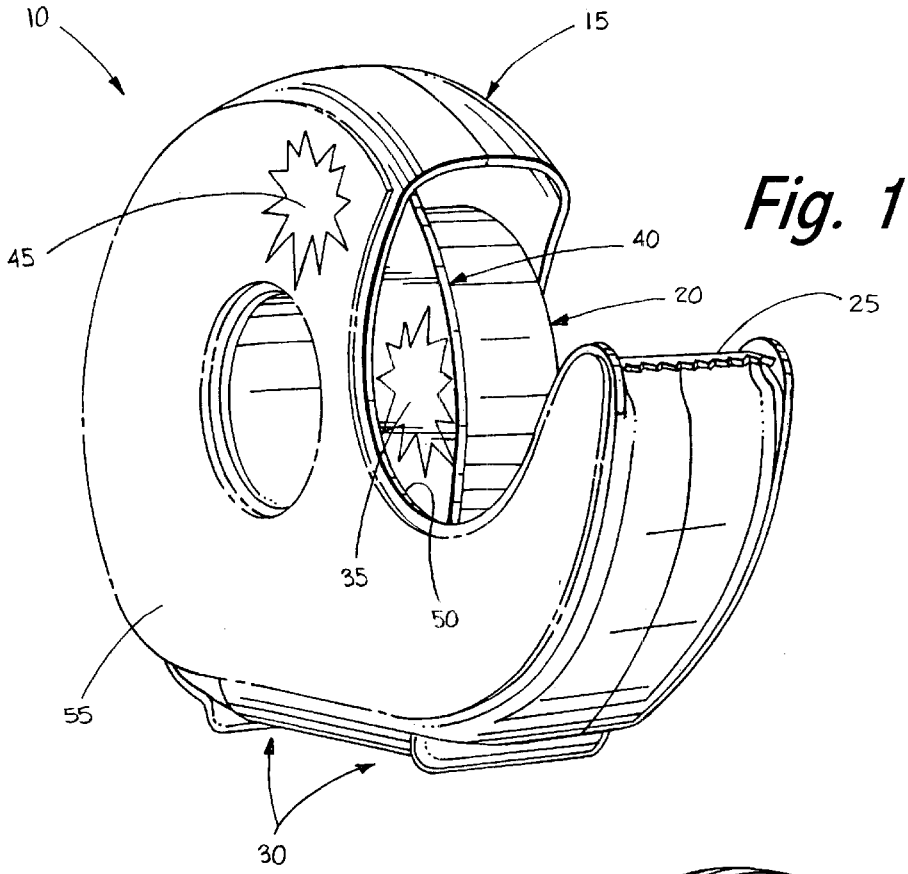
FIG. 1 is a left-side, perspective view illustrating one embodiment of a tape dispenser of the present invention, wherein a rotatable display component can be seen through a portion of the dispenser body.

An embodiment of a tape dispenser 10 of the present invention is illustrated in FIGS. 1–8. The present invention contemplates a tape dispenser 10 for distributing common invisible or transparent adhesive cellulose tapes, although the dispenser may also be used with other types of tape and non-tape materials as well. More particularly, the tape dispenser of the present invention is designed to display a graphic, such as an image, wording, or a combination thereof.

While the overall shape of the tape dispenser 10 may vary, the dispenser body 15 is shown here in the form in which tape dispensers most commonly appear. Generally, the dispenser body 15 comprises a hollow, plastic case in which a tape roll may be placed for dispensing. The tape dispenser 10 also typically contains a cutting device 25 for separating individual sections from the tape roll 20. Although not required, the tape dispenser 10 may also possess a base portion 30, such as a flat section or ribs for aiding the tape dispenser to stand upright.

The novel display portion of the tape dispenser can be seen in FIG. 1. A movable graphic 35 can be seen to exist on a rotatable display component 40, while a fixed graphic 45 is shown to reside on the dispenser body 15. Although a fixed graphic 45 is shown on the dispenser body 15 in this particular embodiment, the rotatable display component 40 may also be used alone.

The rotatable display component 40 is preferably designed to reside within the dispenser body 15, and more preferably, between the interior wall of the dispenser body and the tape roll 20. One or more movable graphics 35 are preferably placed on the rotatable display component 40, such that they will appear in an aperture 50 of the dispenser body 15 during rotation of the rotatable display component. The rotatable display component 40 may be secured within the dispenser body in a variety of ways, including, without limitation, by affixing to the spindle (not shown) of the tape roll 20 or by contact with adhesive present on the edges of the tape roll. The rotatable display component 40 may be affixed within the dispenser body 15 in such a manner that rotation thereof may only occur in conjunction with rotation of the tape roll 20. Alternatively, the rotatable display component 40 may be in releasable communication with the tape roll 20, such that the rotatable display component may be rotated independently thereof.

In FIG. 1, the second graphic 45 is shown to be attached to the dispenser body by way of a sticker or label 55. The label 55 is preferably affixed to the outside of the dispenser body 15, however the label could also be placed on the inside of the dispenser body. Other methods of placing a graphic 45 on the dispenser body may also be employed, such as silk-screening or hot stamping, for example. Although only a single graphic 45 is depicted on the label 55 in this particular embodiment, multiple graphics may be used.

The movable graphic 35 and the fixed graphic 45 may be used to display images, wording, or both. The message or images conveyed by the movable graphic 35 and the fixed graphic 45 may be independent of one another, or alternatively, the movable graphic and fixed graphic may complement each other, such as to form a composite image or wording, for example.

Figure 2:
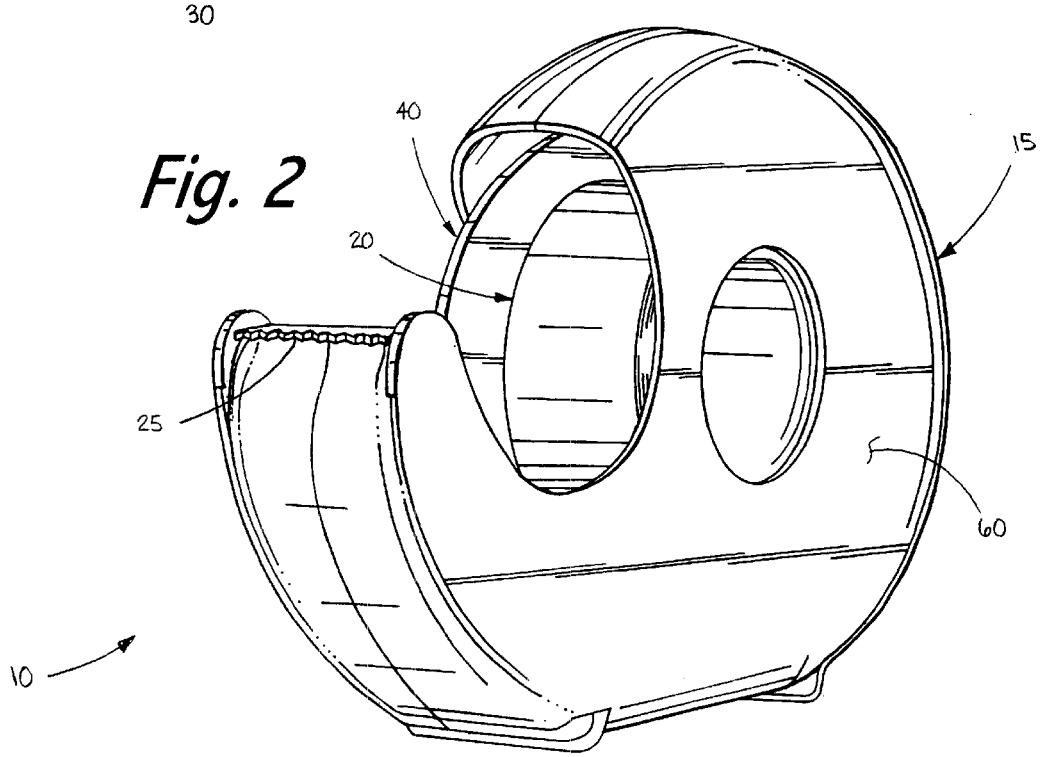
FIG. 2 is an additional perspective view, showing the right side of the tape dispenser of FIG. 1.

The right-side of the tape dispenser 10 of FIG. 1 may be seen in FIG. 2. In this particular embodiment, there is no label or graphic on the surface 60 of the dispenser body 15. Although not shown in FIG. 2 for purposes of clarity, if the tape dispenser 10 is constructed from a transparent or translucent material, the right-side of both the rotatable display component 40 and tape roll 20 will be visible, at least to some extent, through the dispenser body 15. In this embodiment, the tape roll 20 is shown to be of lesser diameter than the rotatable display component 40, however, the tape roll may also be of equal or greater size.

Figure 3:
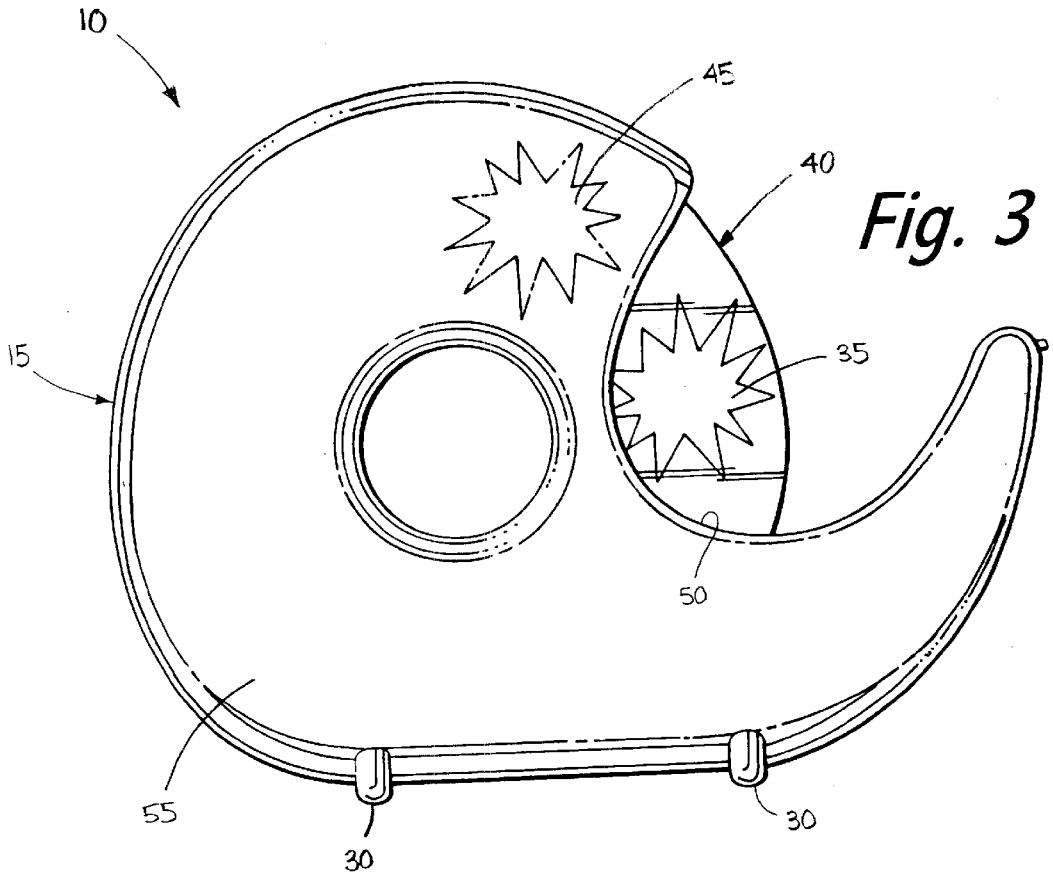
FIG. 3 shows a left-side view of the tape dispenser of FIG. 1.
Figure 4:
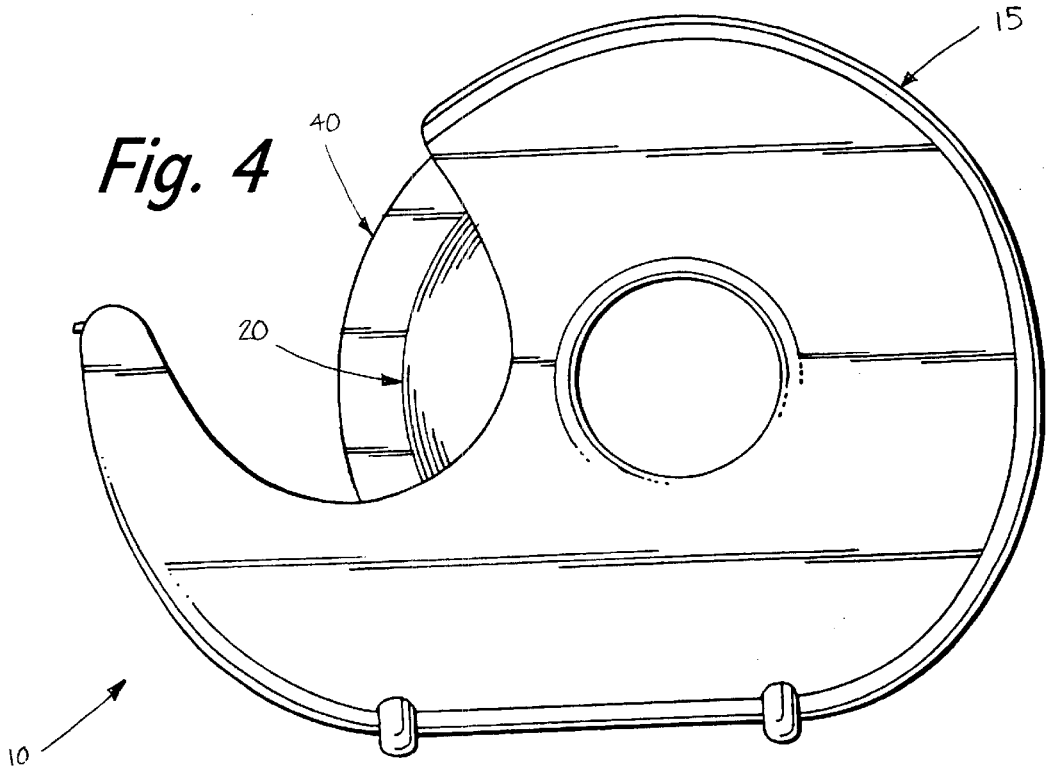
FIG. 4 is a right-side view of the tape dispenser of FIG. 1.
Figure 5:
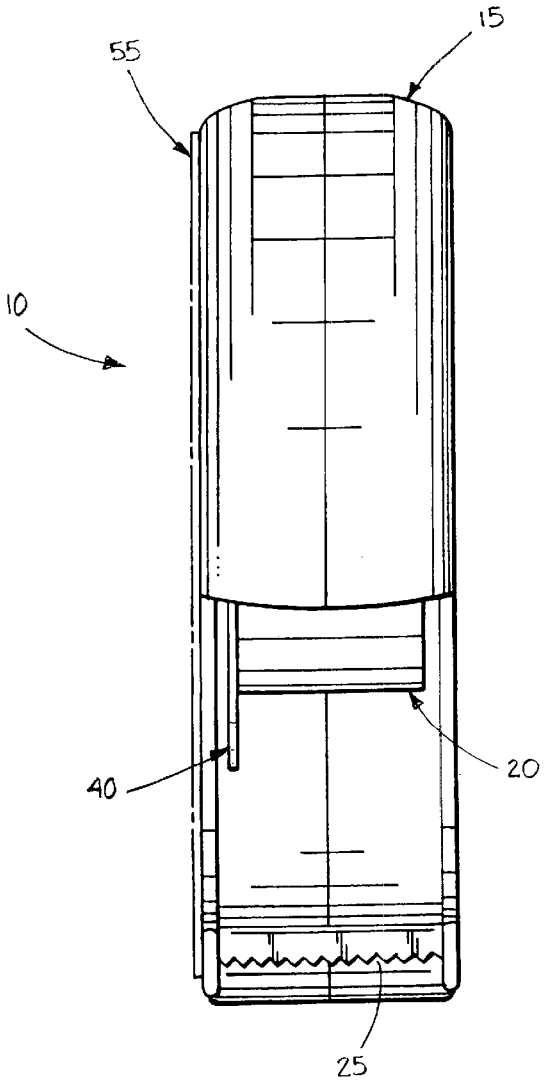
FIG. 5 is a top view of the tape dispenser of FIG. 1.

In FIGS. 3–4, the location of the rotatable display component 40 and movable and fixed graphic 35, 45 with respect to the dispenser body 15 can be more clearly seen. FIG. 3 illustrates how the first graphic 35 on the rotatable display component 40 may appear in the aperture 50 of the dispenser body 15. It can also be observed how the movable graphic 35 and the fixed graphic 45 may work in conjunction to convey a multi-part or larger image or phrase, for example.

The orientation of the tape roll 20 with respect to the rotatable display component 40 may be observed by reference to FIG. 4. As discussed above, although the tape roll 20 is shown to be of lesser diameter than the rotatable display component 40, the tape roll may also be of equal or greater size.

Figure 6:
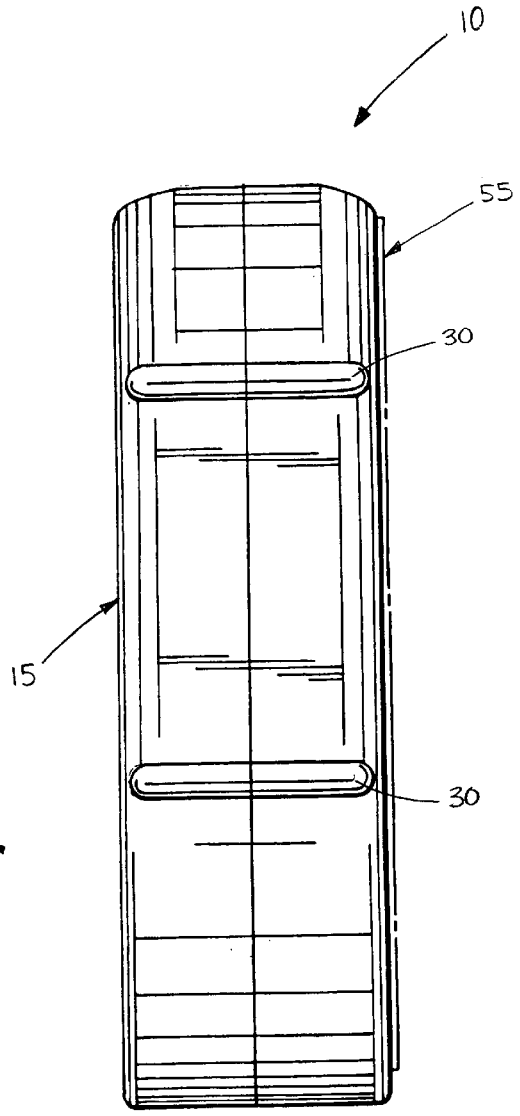
FIG. 6 is a bottom view of the tape dispenser of FIG. 1.
Figure 7:
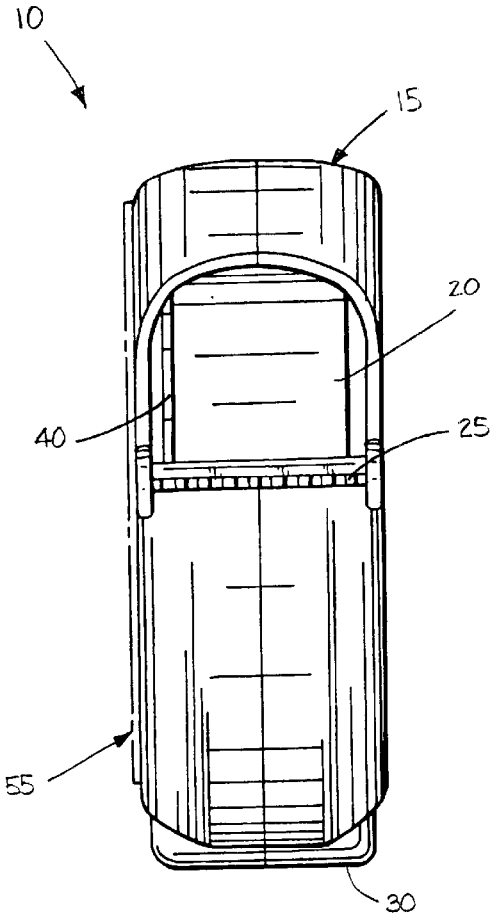
FIG. 7 is a front view of the tape dispenser of FIG. 1.
Figure 8:
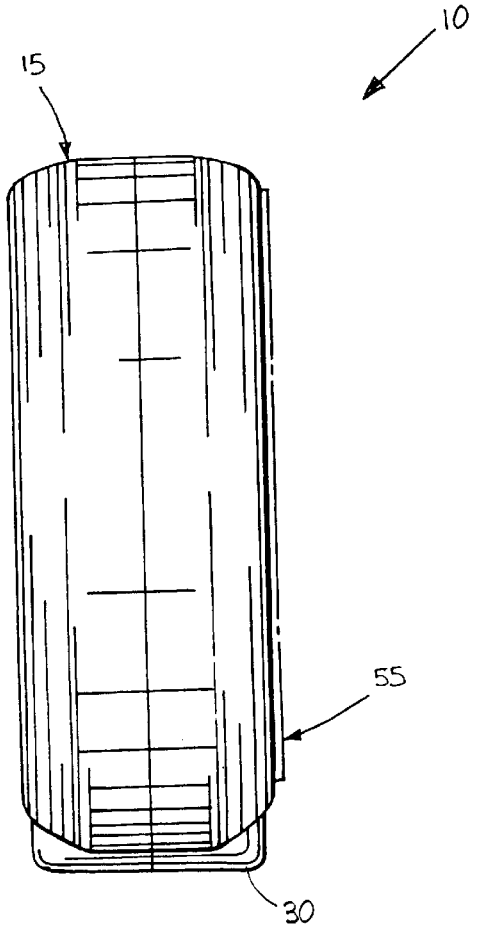
FIG. 8 is a rear view of the tape dispenser of FIG. 1.

Other features of this embodiment of the tape dispenser 10 of the present invention may be more readily observed by reference to FIGS. 5–8. The relationship of the tape roll 20 and rotatable display component 40 are clearly shown in FIG. 5. The label 55 containing the fixed graphic 45 may be seen affixed to the left-hand side of the dispenser body 15 in both of FIGS. 5 and 6. FIG. 6 also shows the optional base portion 30 for assisting in allowing the tape dispenser 10 to stand upright. Although the base portion 30 is shown in FIG. 6 to consist essentially of two protrusions, other structures may also be provided for producing a similar result.

Figure 9:
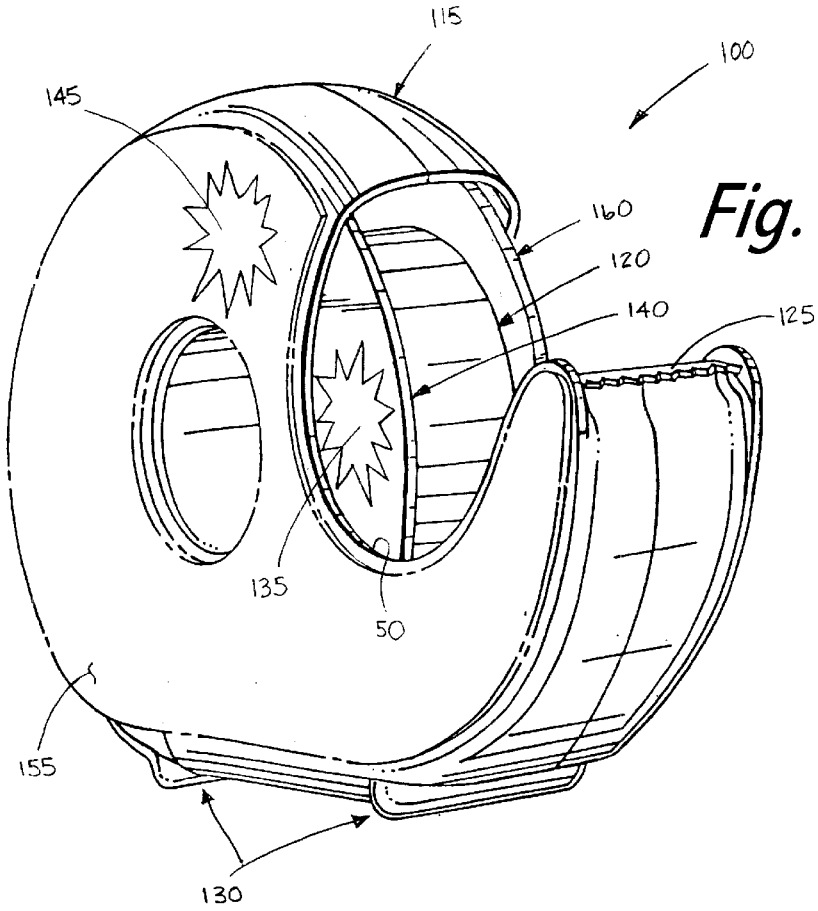
FIG. 9 is a left-side, perspective view illustrating an alternate embodiment of a tape dispenser of the present invention, wherein two rotatable display components can be seen through a portion of the dispenser body.
Figure 10:
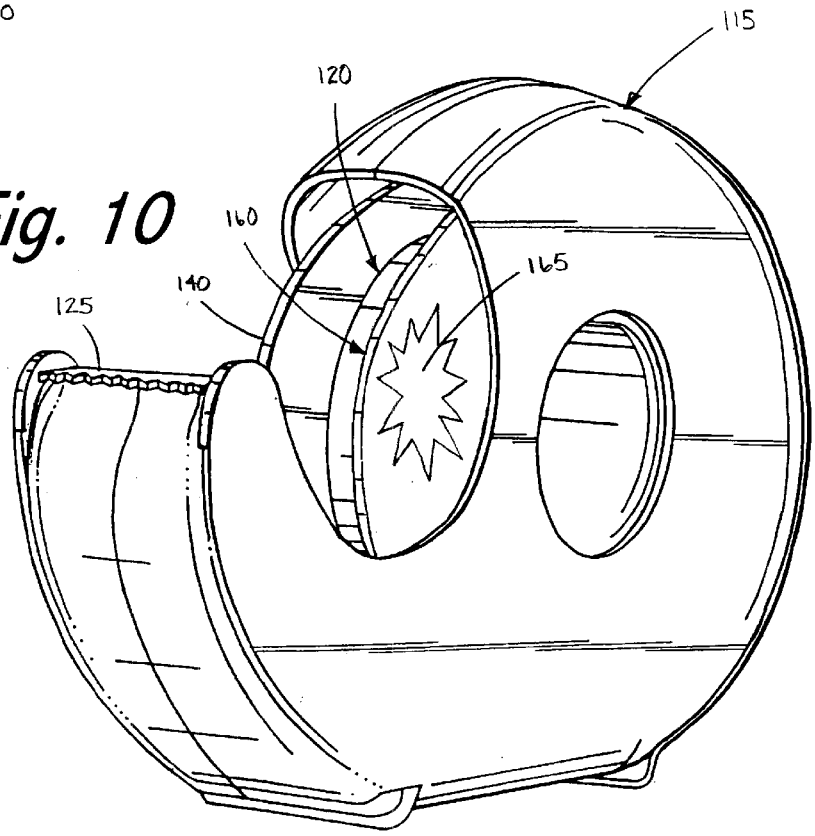
FIG. 10 is an additional perspective view, showing the right side of the tape dispenser of FIG. 9.
Figure 11:
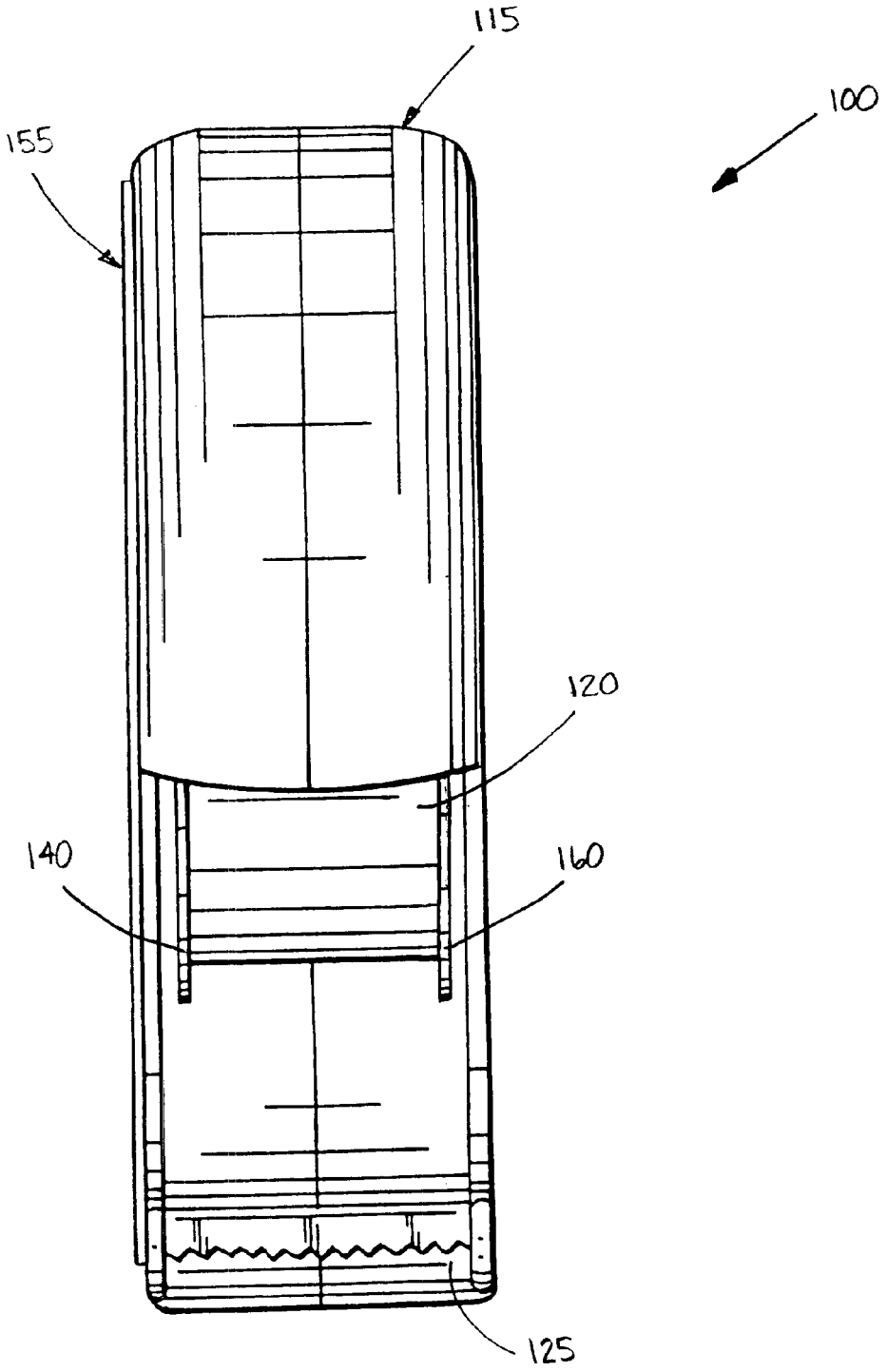
FIG. 11 is a top view of the tape dispenser of FIG. 9.

An alternate embodiment of a tape dispenser 100 of the present invention is shown in FIGS. 9–11. This embodiment of the tape dispenser 100 resembles the embodiment illustrated in FIGS. 1–8. Similarly, this embodiment is shown to have a dispenser body 115 within which there is housed a tape roll 120. A base portion 130 is provided to improve the stability of the tape dispenser 100 in its upright position. A first movable graphic 135 is shown to reside on a first rotatable display component 140, which is preferably located to rotate within the dispenser body 115 so that the first rotatable graphic will appear in an aperture 150 thereof. Multiple graphics of a similar or different nature may be placed on the first rotatable display component 140, such that different graphics will appear in the aperture 150 as the first rotatable display component is rotated.

A fixed graphic 145 is shown to be attached to the dispenser body 115 by way of a sticker or label 155. The label 155 is preferably affixed to the outside of the dispenser body 115, however the label could also be placed on the inside of the dispenser body. Although only a single fixed graphic 145 is depicted on the label 155 in this particular embodiment, multiple fixed graphics may be used.

As in the embodiment of FIGS. 1–8, the first movable graphic 135 and the fixed graphic 145 may be used to display images, wording, or both. The message or images conveyed by the first movable graphic 135 and the fixed graphic 145 may be independent of one another, or alternatively, the first movable graphic and the fixed graphic may complement each other, such as to form a composite image or wording, for example.

Unlike the embodiment of FIGS. 1–8, however, the embodiment of the tape dispenser 100 shown in FIGS. 9–11 employs a second rotatable display component 160. The second rotatable display component 160 is preferably located on the side of the dispenser body 115 opposite that of the first rotatable display component 140. A second movable graphic 165 is preferably located on the second rotatable display component 160. As with the first rotatable display component 140, and the first movable graphic 135, multiple graphics of a similar or different nature may be placed on the second rotatable display component 160, such that different graphics will appear in the aperture 150 as the second rotatable display component is rotated. By utilizing a second rotatable display component 160 and a second movable graphic 165, an image or wording may be conveyed to the user of the tape dispenser 100 regardless of which side of the dispenser body 115 is currently being observed.

Figure 13:
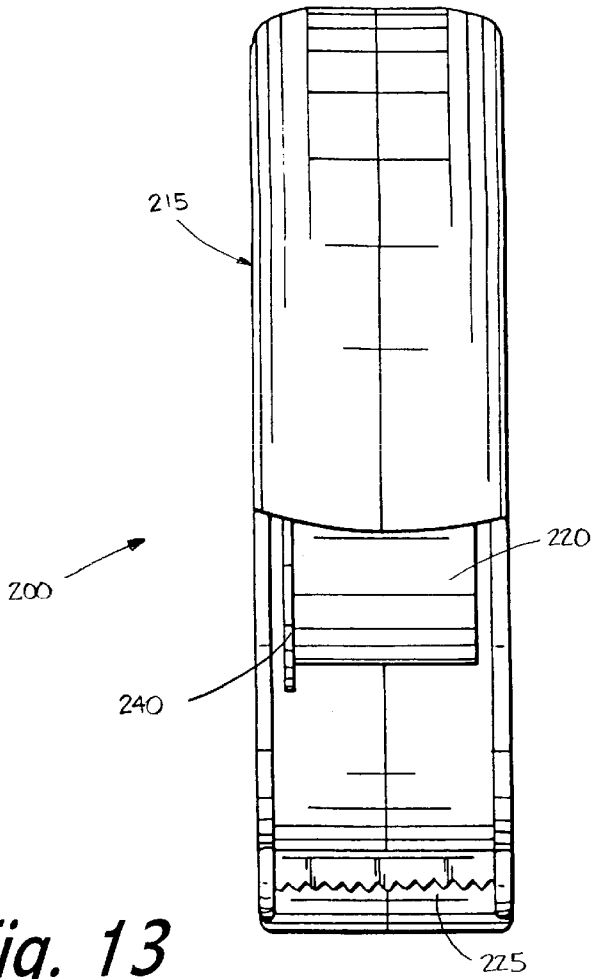
FIG. 13 is a top view of the tape dispenser of FIG. 12.
Figure 12:
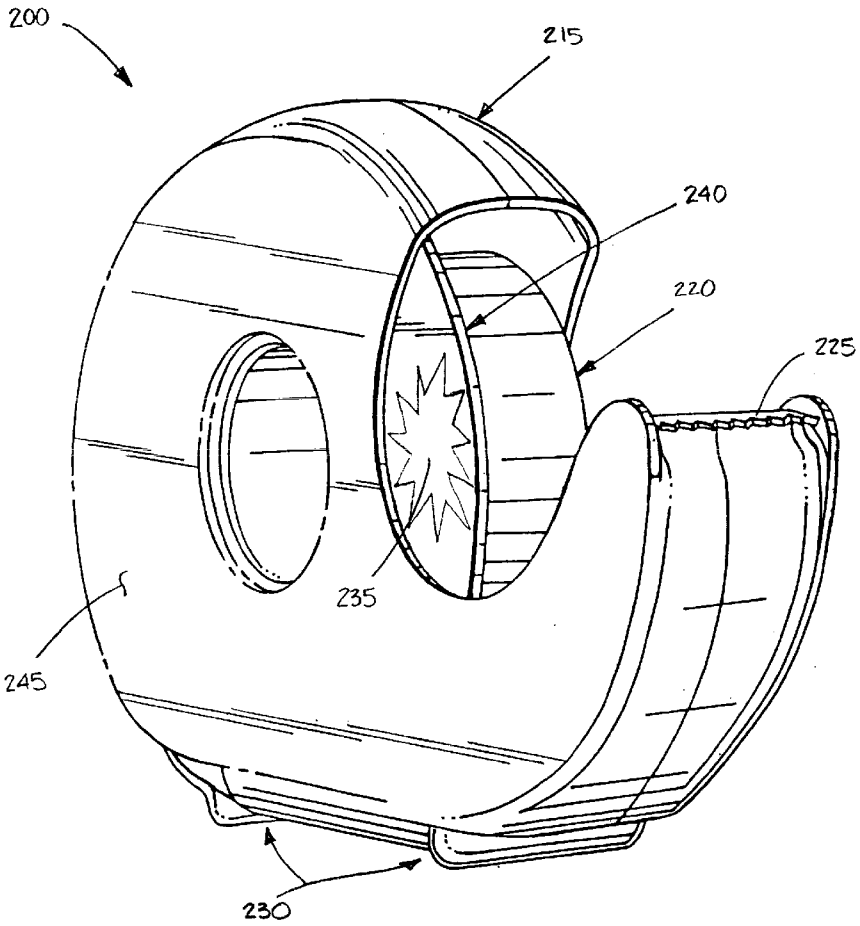
FIG. 12 is a left-side, perspective view illustrating an alternate embodiment of a tape dispenser of the present invention, wherein a rotatable display component can be seen through a portion of the dispenser body.

Another embodiment of a tape dispenser 200 of the present invention is depicted in FIGS. 12–13. This embodiment of the tape dispenser 200 is substantially identical to the embodiment of FIGS. 1–8, except that this embodiment lacks a label or fixed graphic on the surface 245 of the side of the dispenser body 215 having a first rotatable display component 240 and first movable graphic 235. Like the previous embodiments of FIGS. 1–11, the tape dispenser 200 is shown to have a tape roll 220 and a cutting device 225, and may further include a base portion 230.

Figure 15:
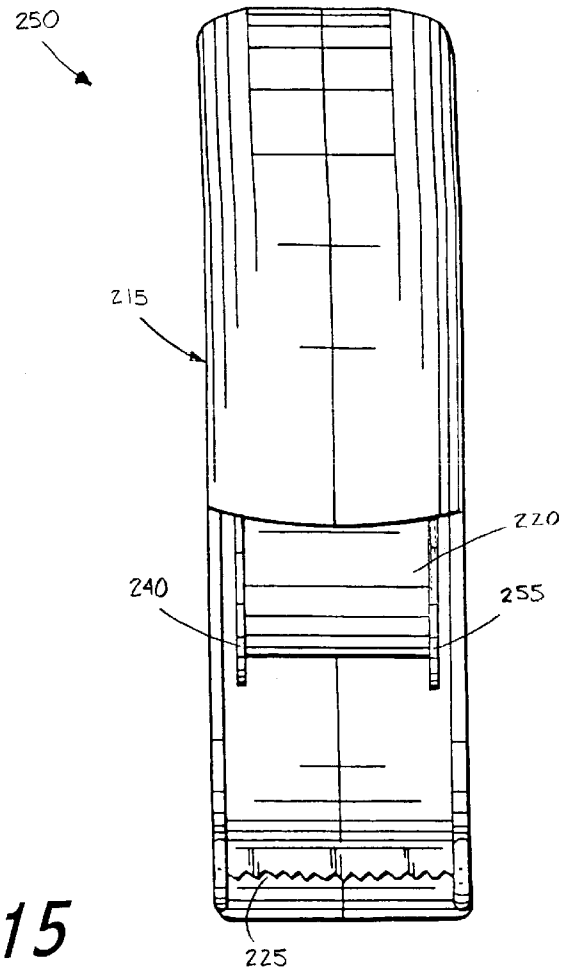
FIG. 15 is a top view of the tape dispenser of FIG. 14.
Figure 14:
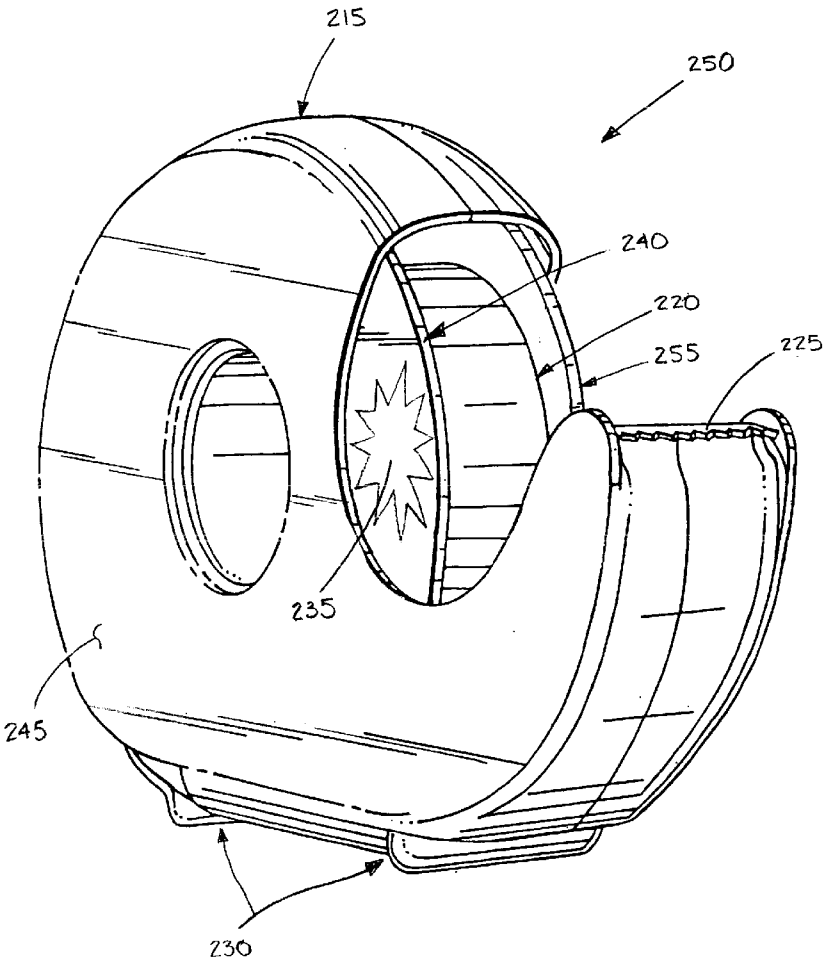
FIG. 14 is a left-side, perspective view illustrating an alternate embodiment of a tape dispenser of the present invention, wherein two rotatable display components can be seen through a portion of the dispenser body.

An alternate embodiment of a tape dispenser 250 of the present invention may be seen in FIGS. 14–15. The tape dispenser 250 of FIGS. 14–15 is essentially identical to the tape dispenser 200 shown in FIGS. 12–13, except that this embodiment has a second rotatable display component 255 on the opposite side of the dispenser body from that of the first rotatable display component 240. Although not shown in FIGS. 14–15, the second rotatable display component 255 may possess one or more graphics located thereon. The first and second rotatable display components 240, 255 may move with rotation of the tape roll 220, or alternatively, may each move independently of the tape roll or one another.

Figure 17:
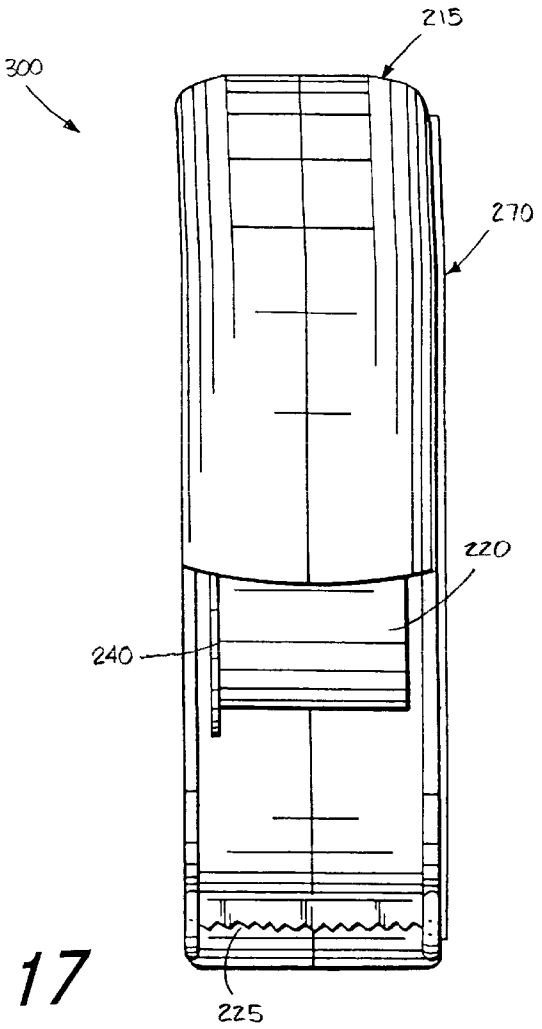
FIG. 17 is a top view of the tape dispenser of FIG. 16.
Figure 16:
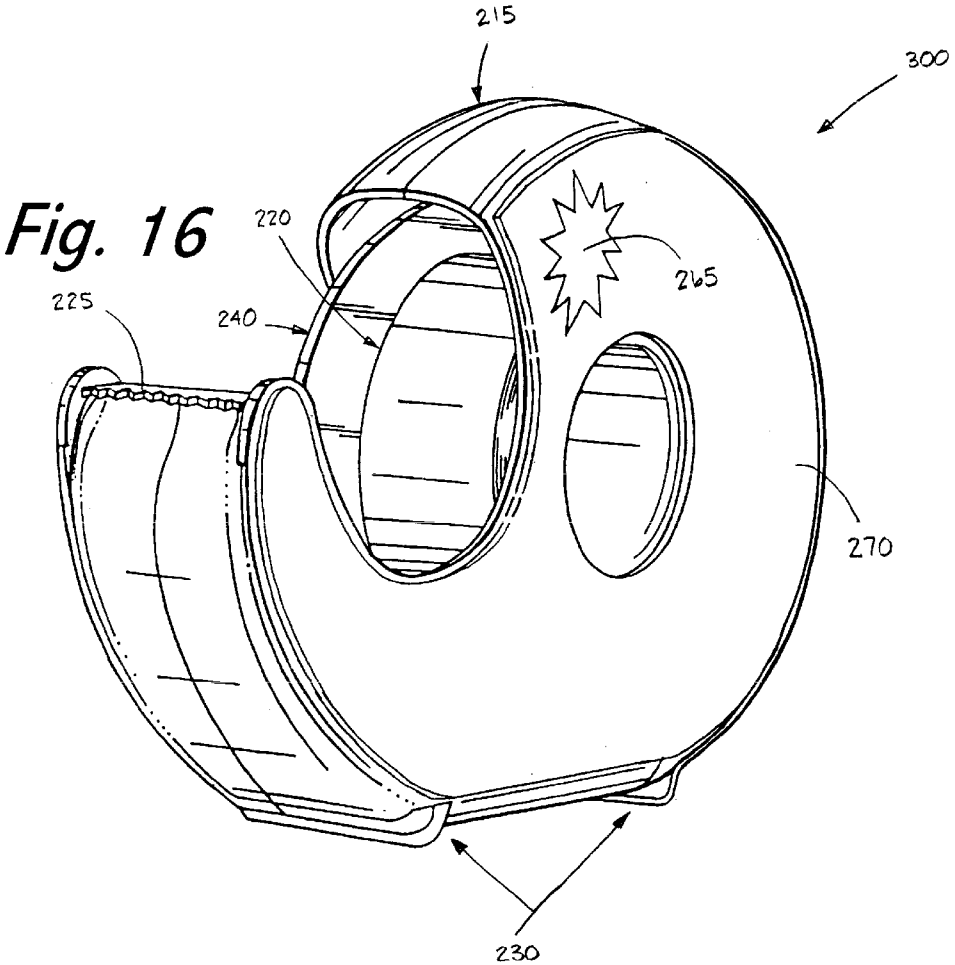
FIG. 16 is a right-side, perspective view illustrating an alternate embodiment of a tape dispenser of the present invention, wherein a rotatable display component can be seen through a portion of the dispenser body.

An alternate embodiment of a tape dispenser 300 of the present invention is illustrated in FIGS. 16–17. This particular embodiment of the tape dispenser 300 is substantially the same as the embodiment of FIGS. 12–13, with the addition of a fixed graphic 265 to the right-side of the dispenser body, preferably by means of a sticker or label 270. One or more fixed graphics 265 may be placed on the label 270.

Figure 19:
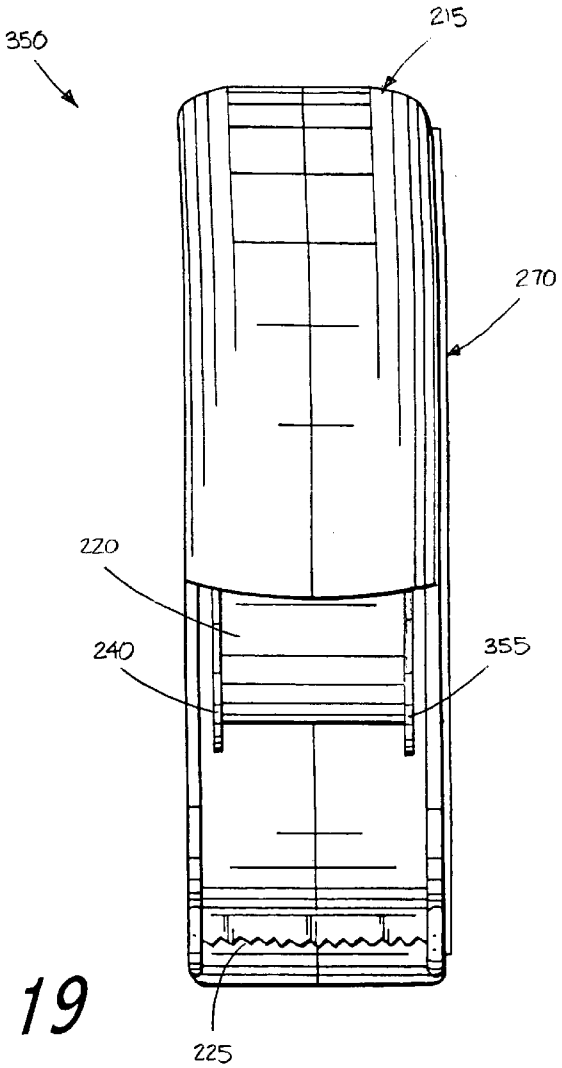
FIG. 19 is a top view of the tape dispenser of FIG. 18.
Figure 18:
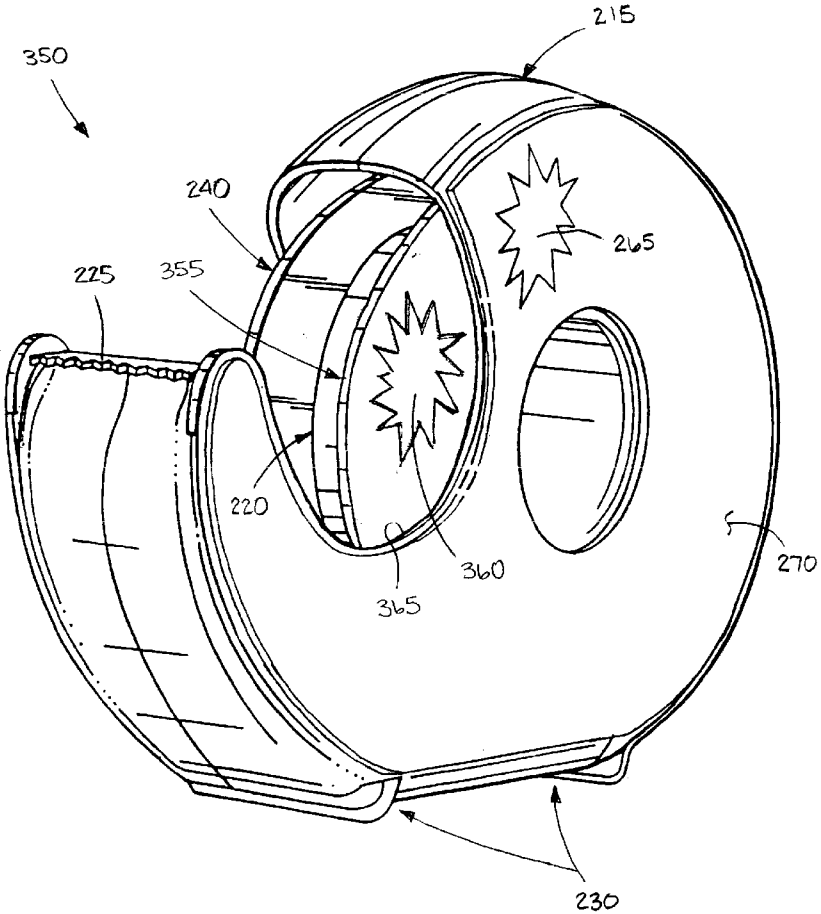
FIG. 18 is a right-side, perspective view illustrating an alternate embodiment of a tape dispenser of the present invention, wherein two rotatable display components can be seen through a portion of the dispenser body.

Yet another embodiment of a tape dispenser 350 of the present invention is shown in FIGS. 18–19. In this embodiment of the tape dispenser 350, the tape dispenser may be seen to have essentially the same structure as the embodiment of FIGS. 16–17, with the addition of a second rotatable display component 355 and movable graphic 360. Like the first rotatable display component 240, the second rotatable display component 355 is preferably located within the dispenser body 215 so that the second movable graphic 360 will appear in an aperture 365 in the right-side of the dispenser body 215. As discussed in regard to the above-described embodiments, the fixed graphic 265 and the second movable graphic 360 may convey an independent image or message, or alternatively, may work in conjunction.

Figure 20:
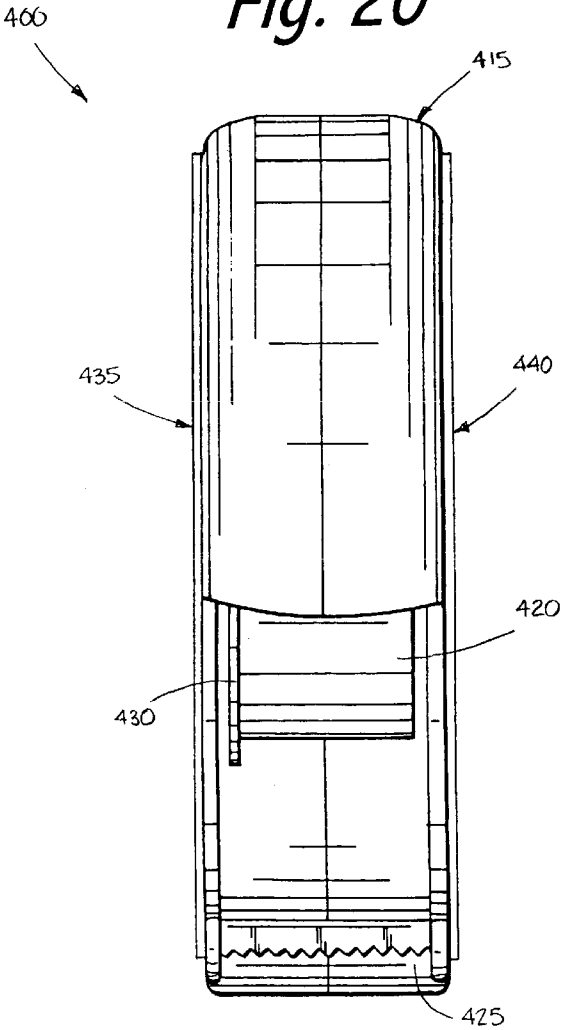
FIG. 20 shows a top view of an alternate embodiment of the tape dispenser of the present invention having a rotatable display component, and wherein a graphic is present on both the left side and right side of the dispenser body.

Still another embodiment of a tape dispenser 400 of the present invention can be seen by reference to FIG. 20. In this embodiment, the tape dispenser 400 is shown to be comprised of a dispenser body 415 that houses a tape roll 420 and a cutting device 425 therefor. A first rotatable display component 430 resides between the tape roll 420 and the inside of the dispenser body 415. Although not shown in this embodiment, as in the above described embodiments, one or more first movable graphics are preferably placed on the first rotatable display component 430. Unlike the previous embodiments, however, the tape dispenser 400 is shown to have a sticker or label 435, 445 on both sides of the dispenser body 415. One or more fixed graphics may be placed on one or both of the stickers or labels 435, 445.

Figure 21:
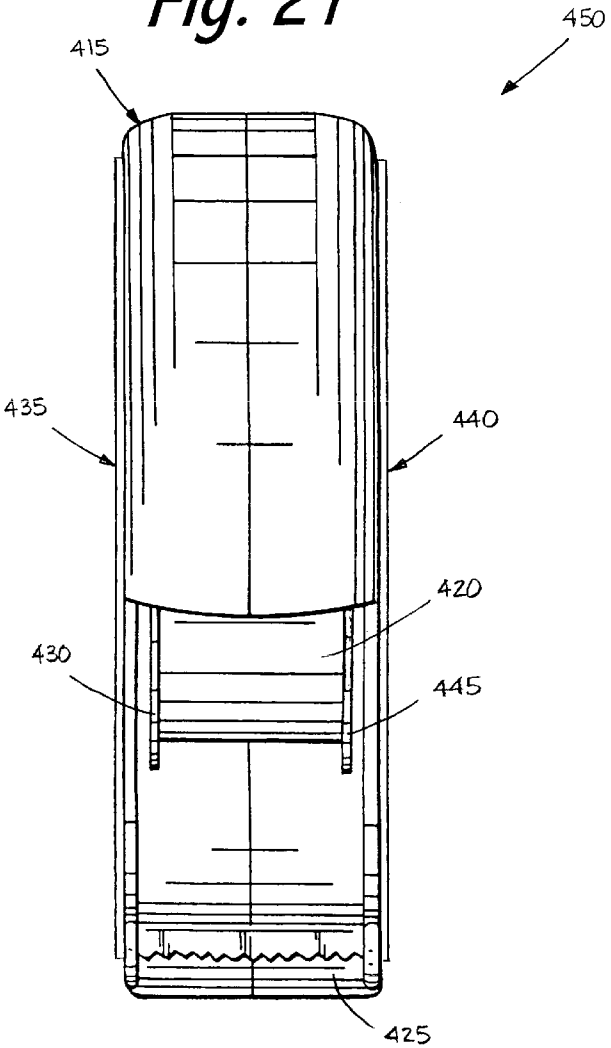
FIG. 21 shows a top view of an alternate embodiment of the tape dispenser of the present invention having two rotatable display components, and wherein a graphic is present on both the left side and right side of the dispenser body

An alternate embodiment of a tape dispenser 450 according to the present invention may be observed in FIG. 21. The tape dispenser 450 is identical to the tape dispenser shown in FIG. 20, but for the addition of a second rotatable display component 445. In this embodiment, the visual presentation created by the sticker or label 435, 445 and accompanying fixed graphic, in conjunction with the rotatable display component 430, 445 and one or more movable graphics, may be observed from either side of the dispenser body 415.

Figure 22:
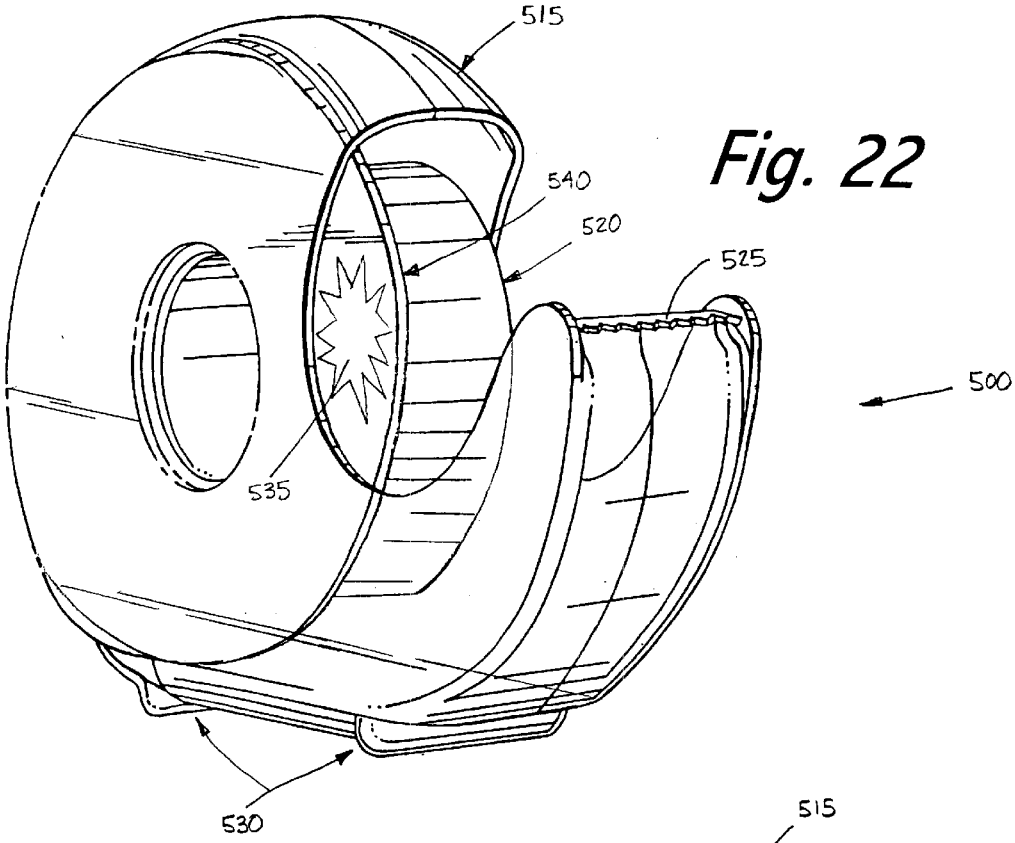
FIG. 22 is a left-side, perspective view illustrating an alternate embodiment of a tape dispenser of the present invention, wherein the entirety of a rotatable display component can be seen through a transparent dispenser body.
Figure 23:
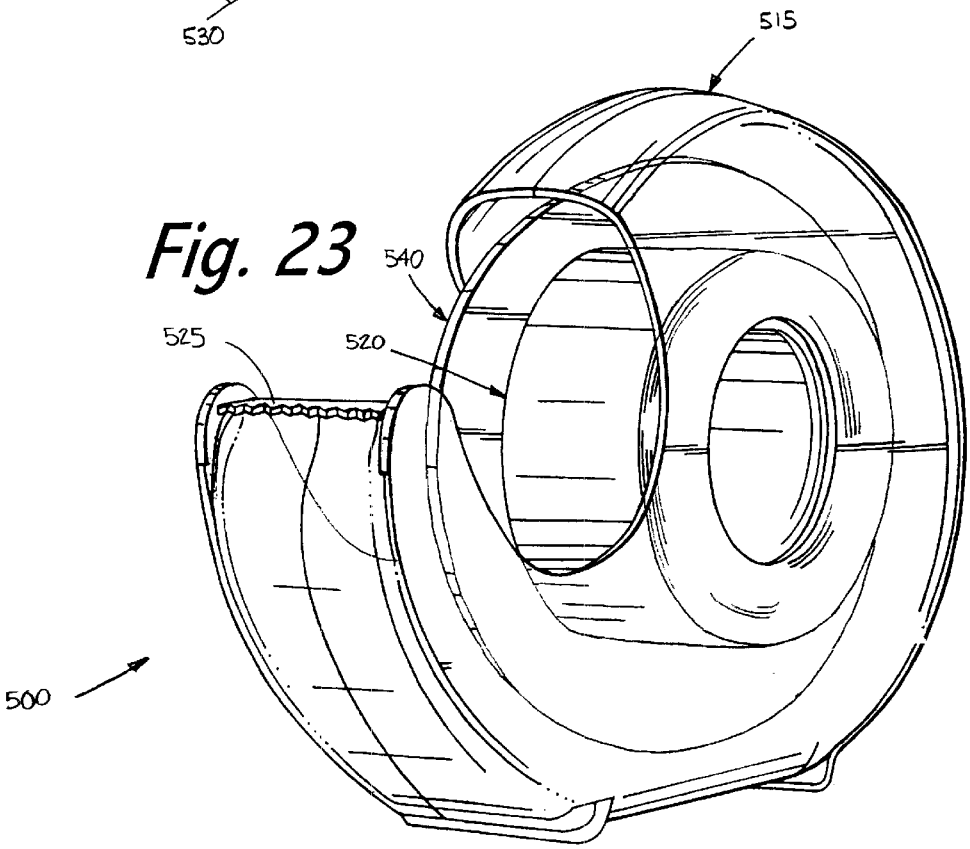
FIG. 23 is a right-side, perspective view of the tape dispenser of FIG. 22.

An additional embodiment of a tape dispenser 500 of the present invention is illustrated in FIGS. 22–23. Like the above-described embodiments, the tape dispenser 500 has a dispenser body 515, a tape roll 520 and cutting device 525 therefor, and a base portion 530. A first movable graphic 535 is shown to reside on a first rotatable display component 540.

In this particular embodiment of the tape dispenser 500, however, the dispenser body 415 is shown to be transparent or translucent. As such, the first rotatable display component

540 and the tape roll 520 may be seen through the dispenser body 515 to at least some degree.

The above-described embodiments are merely exemplary of the present invention. The dispenser body may be of shapes and sizes other than those shown herein. Various materials may be used to manufacture the dispenser body portion of the tape dispenser, such that the dispenser body may be transparent, translucent, or opaque, and any of a variety of colors. A multitude of graphics may be placed on both the rotatable display portion and the dispenser body to convey a message or a scene, for example. The use of rotatable display components and fixed graphics may occur in any combination, including the locating of a rotatable display component on only the right-hand side of the dispenser body (not shown). The present invention may also be applied to similar dispensers for materials other than tape.

Therefore, while certain embodiments of the present invention are described in detail above, the scope of the invention is not to be considered limited by such disclosure, and modifications are possible without departing from the spirit of the invention as evidenced by the following claims:

What is claimed is:

1. A tape dispenser, comprising:

a dispenser body;

a mounting device for receiving a tape roll; and at least one rotatable display component residing between said tape roll and said dispenser body;

wherein said rotatable display component may be rotated, so as to display at least one graphic, in a manner selected from the group consisting of:

rotation independent of said tape roll and rotation in conjunction with said tape roll.

2. The tape dispenser of claim 1, wherein said dispenser body is transparent.

3. The tape dispenser of claim 1, wherein said dispenser body is translucent.

4. The tape dispenser of claim 1, wherein said dispenser body is opaque.

5. The tape dispenser of claim 1, wherein a rotatable display component resides between both sides of said tape roll and said dispenser body.

6. The tape dispenser of claim 1, further comprising at least one fixed graphic located on said dispenser body.

7. The tape dispenser of claim 6, wherein said at least one fixed graphic is part of a label affixed to a surface of said dispenser body.

8. The tape dispenser of claim 6, wherein said at least one fixed graphic is affixed to a surface of said dispenser body by silk-screening.

9. The tape dispenser of claim 6, wherein said at least one fixed graphic is affixed to a surface of said dispenser body by hot stamping.

10. The tape dispenser of claim 6, wherein said at least one fixed graphic is located on the same side of said dispenser body as said rotatable display component.

11. The tape dispenser of claim 10, wherein said at least one fixed graphic works in conjunction with at least one graphic located on said at least one rotatable display component to form a composite graphic.

12. The tape dispenser of claim 6, wherein said at least one fixed graphic is located on the side of said dispenser body opposite that of said rotatable display component.

13. The tape dispenser of claim 6, wherein at least one fixed graphic is located on both sides of said dispenser body.

14. The tape dispenser of claim 1, further comprising a base portion for providing support for said tape dispenser when in an upright position.

15. The tape dispenser of claim 1, further comprising a cutting device for separating individual sections of tape from said tape roll.

16. A tape dispenser, comprising:

a dispenser body;

a mounting device for receiving a tape roll;

a cutting device for separating individual sections of tape from said tape roll;

at least one rotatable display component residing between said tape roll and said dispenser body; and at least one graphic located on said at least one rotatable display component;

wherein said rotatable display component may be rotated, so as to display said at least one graphic, in a manner selected from the group consisting of:

rotation independent of said tape roll and rotation in conjunction with said tape roll.

17. The tape dispenser of claim 16, wherein said dispenser body is transparent.

18. The tape dispenser of claim 16, wherein said dispenser body is translucent.

19. The tape dispenser of claim 16, wherein said dispenser body is opaque.

20. The tape dispenser of claim 16, wherein a rotatable display component resides between both sides of said tape roll and said dispenser body.

21. The tape dispenser of claim 16, further comprising at least one fixed graphic located on said dispenser body.

22. The tape dispenser of claim 21, wherein said at least one fixed graphic is part of a label affixed to a surface of said dispenser body.

23. The tape dispenser of claim 21, wherein said at least one fixed graphic is affixed to a surface of said dispenser body by silk-screening.

24. The tape dispenser of claim 21, wherein said at least one fixed graphic is affixed to a surface of said dispenser body by hot stamping.

25. The tape dispenser of claim 21, wherein said at least one fixed graphic is located on the same side of said dispenser body as said rotatable display component.

26. The tape dispenser of claim 25, wherein said at least one fixed graphic works in conjunction with said at least one graphic located on said at least one rotatable display component to form a composite graphic.

27. The tape dispenser of claim 26, further comprising a base portion for providing support for the tape dispenser when in an upright position.

28. The tape dispenser of claim 21, wherein said at least one fixed graphic is located on the side of said dispenser body opposite that of said rotatable display component.

29. The tape dispenser of claim 21, wherein at least one fixed graphic is located on both sides of said dispenser body.

30. The tape dispenser of claim 16, further comprising a base portion for providing support for the tape dispenser when in an upright position.

31. A tape dispenser, comprising:

a dispenser body;

a mounting device for receiving a tape roll;

a cutting device for separating individual sections of tape from said tape roll;

at least one rotatable display component residing between said tape roll and said dispenser body; and at least one graphic located on said at least one rotatable display component;

wherein said rotatable display component may be rotated, so as to display said at least one graphic through an aperture of said dispenser body, in a manner selected from the group consisting of: rotation independent of said tape roll and rotation in conjunction with said tape roll.

32. The tape dispenser of claim 31, wherein said dispenser body is transparent.

33. The tape dispenser of claim 31, wherein said dispenser body is translucent.

34. The tape dispenser of claim 31, wherein said dispenser body is opaque.

35. The tape dispenser of claim 31, wherein a rotatable display component resides between both sides of said tape roll and said dispenser body.

36. The tape dispenser of claim 31, further comprising at least one fixed graphic located on said dispenser body.

37. The tape dispenser of claim 36, wherein said at least one fixed graphic is part of a label affixed to a surface of said dispenser body.

38. The tape dispenser of claim 36, wherein said at least one fixed graphic is affixed to a surface of said dispenser body by silk-screening.

39. The tape dispenser of claim 36, wherein said at least one fixed graphic is affixed to a surface of said dispenser body by hot stamping.

40. The tape dispenser of claim 36, wherein said at least one fixed graphic is located on the same side of said dispenser body as said at least one rotatable display component.

41. The tape dispenser of claim 40, wherein said at least one fixed graphic works in conjunction with at least one graphic located on said at least one rotatable display component to form a composite graphic.

42. The tape dispenser of claim 36, wherein said at least one fixed graphic is located on the side of said dispenser body opposite that of said at least one rotatable display component.

43. The tape dispenser of claim 32, wherein at least one fixed graphic is located on both sides of said dispenser body.

* * * * *